United States Patent [19]

Forsman

[11] Patent Number: 4,494,986

[45] Date of Patent: Jan. 22, 1985

[54] GOLD EXTRACTING PROCESS AND APPARATUS

[76] Inventor: Donald Forsman, 467 Emerson Ave., Yuba City, Calif. 95991

[21] Appl. No.: 292,953

[22] Filed: Aug. 14, 1981

[51] Int. Cl.[3] ..... C22B 11/10

[52] U.S. Cl. ..... 75/109; 75/118 R; 423/42; 209/41; 209/48; 209/50

[58] Field of Search ..... 209/41, 48, 50; 420/507; 75/109, 118 R; 423/42

[56] References Cited

U.S. PATENT DOCUMENTS

| | | | |
|---|---|---|---|
| 196,212 | 10/1877 | Forster et al. | 209/48 |
| 227,717 | 5/1880 | Ball | 209/48 |
| 645,188 | 3/1900 | Rider | 75/118 R |
| 2,712,931 | 7/1955 | Maddock | 75/109 |

*Primary Examiner*—John Doll
*Assistant Examiner*—Robert L. Stoll
*Attorney, Agent, or Firm*—Mark C. Jacobs

[57] ABSTRACT

A process and apparatus for extracting gold fines and other precious metals dissolved or suspended in water and not usually visible to the naked eye by circulating a stream of water determined to contain such gold fines and the like downwardly through a tank and into contact with electrostatically charged particles of mercury thereby causing any gold or other precious metals in the water to react with the mercury forming amalgams. The gold and other precious metals may then be separated from the amalgams by any suitable techniques known in the art.

4 Claims, 6 Drawing Figures

GOLD EXTRACTING PROCESS AND APPARATUS

BACKGROUND OF THE INVENTION

1. Field of the Invention

The invention relates to a process and apparatus for extracting gold fines from water; and, more particularly, to a process and apparatus for recovering minute gold fines and other precious metals from water, such as ordinary tap water.

2. Description of the Prior Art

No one can be unaware of the tremendous increase in the value of gold in recent years. Many of the gold strikes in the U.S. have long since payed out and little gold mining is being carried out. When the famous gold strikes were made in the past, the finds were quickly depleted and it became uneconomical to mine the extremely small particles of gold, called fines, from the rock and streams and the like. In fact, it has long been known that ordinary tap water, particularly that of the Western states, contains gold fines and other precious fines. Further, in various industrial processes, such as photography, it has long been known that silver and the like can be recovered from the water used in the process. Heretofore, such recovery, in all instances, was uneconomical or required complex and expensive equipment.

Certain techniques have been suggested over the years for recovering gold and other precious metals from water. As a general rule, recovery is made from water or a slurry of pulverized rock in which it has been determined that the valuable metals reside. In one known gold extracting process, finely ground ore is mixed with a powerful cyanide solution which, when allowed to settle, settles out waste while allowing gold-bearing cyanide to flow off. This solution is then mixed with zinc dust and a zinc-gold compound is obtained. However, since cyanide is highly poisonous, special care must be taken to prevent animals and humans from accidental poisoning. Such processes, besides being expensive and time-consuming, rely on the use of cyanides and examples thereof are described in U.S. Pat. Nos. 529,262; 1,923,948; and 2,954,290.

In U.S. Pat. No. 645,188, mercury alone is used to form an amalgam with gold but the mercury must be heated adding to the cost of the operation of the process. In U.S. Pat. No. 736,036, a solvent containing fines is flowed into contact with mercury which must be kept charged with an electropositive metal, such as sodium. In U.S. Pat. No. 1,948,781, a centrifugal process is used to separate free milling gold from an amalgam with mercury. In U.S. Pat. No. 3,729,182, a complicated system is used to extract precious metals from ores where the ores containing the metals are contacted with mercury in an electrically isolated condition.

It can be seen from the foregoing that, either poisonous cyanide is suggested, or time-consuming and expensive processes, requiring heating, other metals, centrifuging, electric isolation, etc. are proposed which increases the cost of the process. Such prior art processes have also proven inefficient and too complex for ordinary use. There thus exists a need for a simple and safe inexpensive process and apparatus for recovering gold and other precious metals from water, such as ordinary tap water, or slurries containing gold-bearing fines and the like.

SUMMARY OF THE INVENTION

It is an object of this invention to provide an improved process and apparatus for recovering gold and other precious metals from water.

It is a further object of this invention to provide a process for recovering gold and other precious metals in an efficient manner without the use of dangerous gases.

It is still another object to provide such a process which is easy to use, relatively inexpensive and requiring little attention.

These and other objects are preferably accomplished by providing a tank in which water is circulated therethrough from the top downwardly therein and out the bottom through an elevated vent which is level with the top feed water pipe wherein the circulating water comes into intimate contact with electrostatically charged particles of mercury moving downwardly in the tank and thereby forming amalgams of mercury and gold or other precisou metals which may later be recovered by any suitable techniques known in the art.

DESCRIPTION OF THE PREFERRED EMBODIMENT

Figure 1:
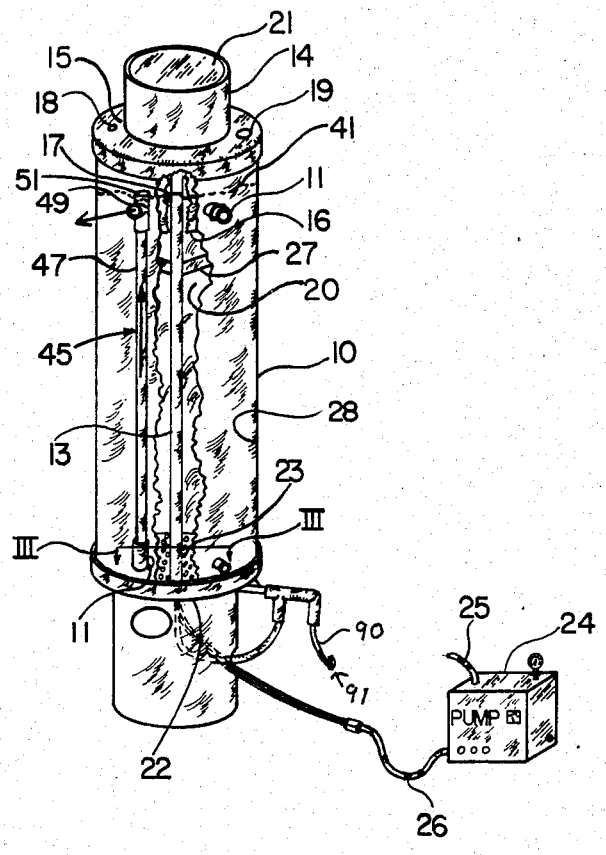
FIG. 1 is a vertical view of apparatus in accordance with the teachings of the invention.

Referring now to FIG. 1 of the drawing, a chamber 10 is shown for recovering gold and the precious metals that may be associated therewith from water, such as a slurry or ordinary tap water. As shown, chamber 10 includes a vertical hollow chamber which may be made of a material that will not chemically react with mercury, such as polyvinyl chloride, having a water inlet 11 opening into the interior of the top thereof and a water outlet 12 exiting out of the bottom and up to the level of the water inlet. An air pipe 13 extends upwardly along generally the central longitudinal axis of chamber 10 opening into the interior of a cap 14 closing off the top 15 of chamber 10. Cap 14, as shown, may also be of a material similar to chamber 10, and extends down into the interior of the upper portion of chamber 10, below water inlet 12, and is open at the bottom 16 thereof. Alternatively, cap 14 may be closed at the bottom with apertures therein for reasons to be discussed.

The interior 17 of cap 14 forms a mercury particulating and polarizing chamber, as will be discussed, and may be vented, as at vent 18. Chamber 10 may also be vented, as at vent 19, as shown. The portion of the interior 20 of chamber 10 below inlet 12 forms a water chamber, as will also be discussed. The upper surface or upper wall 21 of cap 14 may be transparent, or otherwise provide a flat surface of glass, plexiglass, or other suitable, preferably plastic, material, or at least have a central portion as such.

As shown in FIG. 1, outlet 11 opens slightly above the bottom wall 22 of chamber 10 thereby forming a mercury chamber, as will be discussed. Also, as seen, air pipe 13 extends through bottom wall 22 to a pump 24. An air inlet 25 leads to pump 24 and pump 24 is also in fluid communication with the interior of mercury chamber 23 via inlet 26. A plurality of spacers 27 may be coupled to air pipe 13 and the interior wall 28 of chamber 10 to support the same. Mercury outlet 90 is shown secured shut by clamp 91.

Figure 2:
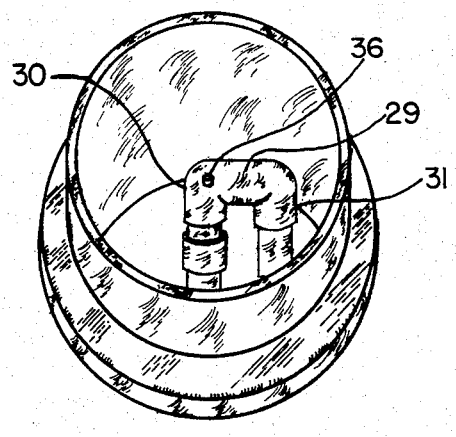
FIG. 2 is a perspective view of the top of the main chamber of the apparatus of FIG. 1 with the cap or top cover removed.
Figure 3:
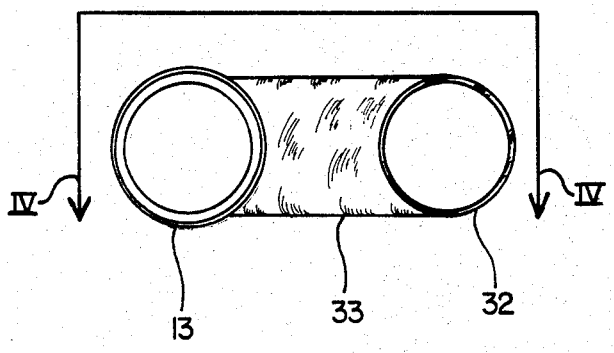
FIG. 3 is a detailed view of the the tubung in the apparatus of FIG. 1 taken along lines III—III thereof.

As shown in FIG. 2, the upper end of pipe 13 opens into a U-shaped elbow 29 having one end 30 connected to pipe 13 and the other end 31 opening downwardly back into the interior of chamber 17. A hole is provided in the upper end of end 30. As shown in FIG. 3, mercury tube 32 winds or extends along air pipe 13, and air from pump 24 enters pipe 13 while mercury from the pool in chamber 23 is circulated up tube 32. A plurality of air inlets 33 (see also FIG. 4) are provided at spaced locations along air pipe 13 so that air flows from pipe 13 out through inlets 33 via openins 34 therein and out lines 35 into mercury tube 32 thus lifting the mercury up tube 32 and out hole 36. There, the mercury impinges on the undersurface of top or cover 21 forming electrostatically charged globules of mercury which then particulate in the interior of chamber 17 and move downwardly into the interior of chamber 10. See preferred embodiment discussion below.

In operation, and referring particularly to FIG. 1, as the air is injected into pipe 13 via inlet 25 and pump 24, it meets with the mercury in tube 32 via air inlets 33 thereby lifting the mercury in tube 32 until it exits out of hole 36. The mercury impinges on wall 21 and forms millions of globules of mercury while the air in pipe 13 exits out of end 31 of elbow 29 and goes down into the interior of chamber 10, while the globules break up and become a multitude of extremely small particles. The top of cap 14 becomes electrostatically charged during the process of impingement. End 31 is disposed above water level 41.

The excess air comes back down into contact with the pool of mercury in chamber 23. Simultaneously, the water flows downwardly and out outlet 11. As the water flows downwardly, it comes into contact with the electrostatically charged mercury particles thereby forming amalgams which collect at the bottom and may later be recovered and the gold or other precious metals separated therefrom in any suitable process not forming part of this invention. The recovered mercury can then be reused in the process.

Any suitable air pressure, such as 10 psi, may be used, and any number of jets or lines 34 may be used. Pump 24 may include suitable means for regulating the pressure thereof as is well known in the art. The water is flowed through chamber 10 at any suitable velocity, eg, 15 gallons an hour, and suitable water pressure control apparatus may be provided at inlet 11 and outlet 12. Chamber 10 may be of any suitable capacity, eg, 13 gallons or so.

Chamber 10 may be of any suitable dimensions, such as ¼ inch thick, 12 inches in internal diameter and about 30 inches in height. Pipe 13 may be 1 inch in internal diameter. Outlet 12 may open about 3 inches below the top of chamber 10. Inlet 11 may be threaded to receive an ordinary garden hose or the like if ordinary tap water is being processed. The air inlets 33 may be varied and spaced where necessary along pipe 13 to carry the mercury therealong. The pipe inlet 26 may be sloped and removable to recover the mercury and amalgams. The apparatus and process herein has been used successfully to recover gold and other precious metals from ordinary tap water. Further, it can have tremendous value in the recovery of gold from slurries known to contain the same or water used in processes, such as photography, where precious metals, such as silver, are known to be present.

Returning once again to FIG. 1, it is seen that designator 45 pertains to a tube that is disposed externally along the side of chamber 10. Outlet 49 mounted on the top of said tube includes a top opening 51. Tube 45 is maintained spaced from the chamber wall by a vane 47. Vane 47 adds stability to said tube.

Figure 4:
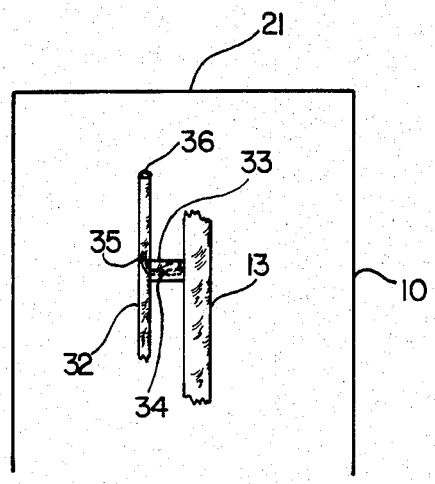
FIG. 4 is a view taken along lines IV—IV of FIG. 3.
Figure 5:
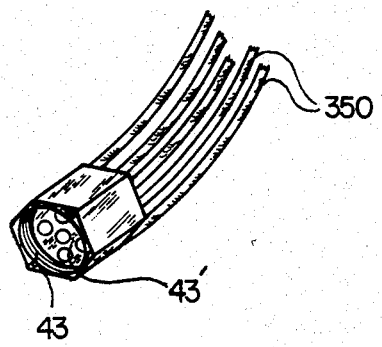
FIG. 5 is a closeup perspective view of one portion of this invention.
Figure 6:
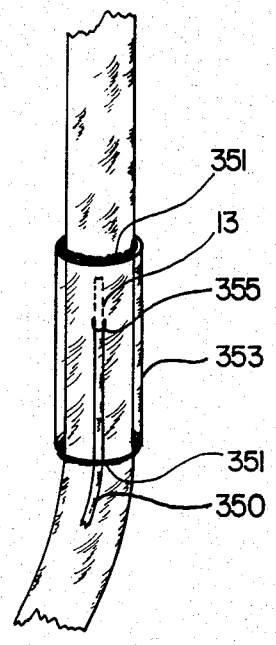
FIG. 6 is a closeup perspective view of another portion of this invention.

While FIGS. 3 and 4 illustrate an operative embodiment the details of a preferred embodiment are shown in FIGS. 5 and 6.

In FIG. 5 there is shown an internally threaded connector 43 having five (5) air lines, collectively designated 350 inserted through the top with 43′ of said connector, whereby when said connector 43 is attached to a source of air, all of the lines collectively designated 350 will receive a portion thereof. Such airline 350 is attached along the periphery of the air line 13 to a specific upwardly spaced location along the elevation of the tube 13. At each location a collar 353 is placed in encircling relationship with tube 13 covering over an aperture 355 in the tube 13. A sealer 351 is placed into the gap surrounding air line 350 at the top and bottom of the collar 353. The sealer helps retain the line 350 in its proper location inserted through aperture 355 in tube 13. Since aperture 355 is adapted and sized to only receive air line 350, the air exiting therefrom can flow only one direction essentially, namely up into tube 13 with the moving mercury.

Generally these air input junctions are spaced every few inches along the elevation of tube 13 as is seen in FIG. 6 where use of these is illustrated.

It is seen that I have developed a unique device for receiving superfine, i.e., particles that are quite minute and generally not recoverable by ordinary and prior art amalgan processes. The device and process of this invention have permitted me to obtain gold fines with high assays from the Feather River of California.

Since certain changes may be made in the above apparatus and process without departing from the scope of the invention herein involved, it is intended therefore, that all matter contained in the above description shall be interpreted as illustrative and not in a limiting sense.

I claim:

1. A process for recovering gold and other precious metals from water comprising the steps of:

flowing water downwardly within an enclosed chamber and out the top thereof;

simultaneously injecting air up said chamber and circulating the same back into said chamber; and flowing mercury up within said chamber in non-contiguous relation to said water being flowed upwardly and using a portion of said injected air to lift said mercury and cause said mercury to exit at a point above said water and into impingement with a portion of said chamber above said water thereby forming electrostatically charged particles of mercury which move downwardly in said chamber into contact with the upwardly flowing water thereby forming amalgams of mercury and gold or other precious metals which can later be separated.

2. In the process of claim 1 including the step of providing the upper surface of said chamber with at least a portion of plexiglass material and and flowing said mercury into contact thereto.

3. In the process of claim 1 including the step of recovering said amalgams from said chamber.

4. In the process of claim 1 including the step of recirculating said mercury within said chamber while simultaneously both injecting air under pressure therein and circulating water therethrough.

* * * * *